United States Patent [19]

Abell

[11] 4,277,201

[45] Jul. 7, 1981

[54] TRANSPORTABLE ROADWAY AND MEANS FOR DEPLOYING THE SAME

[75] Inventor: William R. Abell, Annandale, Va.

[73] Assignee: The United States of America as represented by the Secretary of the Army, Washington, D.C.

[21] Appl. No.: 115,311

[22] Filed: Jan. 25, 1980

[51] Int. Cl.[3] ..... E01C 9/08; E01C 19/52

[52] U.S. Cl. ..... 404/35; 404/99; 414/337

[58] Field of Search ..... 404/18, 35, 36, 73, 404/99, 100; 414/337, 389, 402; 238/14

[56] References Cited

U.S. PATENT DOCUMENTS

| | | | |
|---|---|---|---|
| 1,821,885 | 9/1931 | Fischer | 404/66 |
| 2,384,395 | 9/1945 | Payne | 404/73 |
| 2,780,150 | 2/1957 | Yeoman | 264/261 |
| 4,152,875 | 5/1979 | Soland | 404/35 X |

FOREIGN PATENT DOCUMENTS

| | | | |
|---|---|---|---|
| 2658900 | 6/1978 | Fed. Rep. of Germany | 404/35 |
| 372309 | 5/1973 | U.S.S.R. | 404/35 |
| 137130 | 6/1977 | U.S.S.R. | 404/99 |

*Primary Examiner*—Rodney H. Bonck

*Attorney, Agent, or Firm*—Nathan Edelberg; Robert P. Gibson

[57] ABSTRACT

A transportable roadway which can be folded layer upon layer on a flat bed transporter/launcher vehicle and be easily deployed in a swampy or marshy area to provide a temporary roadway during military operations. The roadway comprises a plurality of sections each including an array of edge to edge planks bonded to a flexible membrane or fabric, with adjoining sections being connected by hinges connecting the end planks of each section in such a way that the roadway can be folded for transport and easily deployed from said transporter/launcher, either from the front or rear thereof.

11 Claims, 5 Drawing Figures

TRANSPORTABLE ROADWAY AND MEANS FOR DEPLOYING THE SAME

The invention described herein may be manufactured and used by or for the United States Government for governmental purposes without the payment of any royalties therefor or thereon.

BACKGROUND OF THE INVENTION

The present invention is concerned with a man-made transportable roadway designed to be easily transported during military operations and quickly and easily deployed in places where it is needed to provide a temporary road surface, especially in swampy or marshy areas where military vehicles may bog down in the absence of the roadway of the present invention. The invention comprises an articulated system of man-made planks held together by a plurality of flexible tension membranes and hinges in such a way that the roadway may be stacked layer upon layer on a vehicle bed designed to transport and deploy the roadway. The lightweight, plastic-encapsulated planks of which the roadway is constructed provide buoyancy which aids in supporting heavy vehicular loads in swamps and marshes. Also, the flexible tension membranes which connect most of the adjacent planks results in a spreading of the load over several adjacent planks.

SUMMARY OF THE INVENTION

The planks are made as long as the desired width of the finished roadway and each plank has a tongue at one edge thereof and a groove at the other. The planks are bonded to the flexible membrane with the tongues and grooves of each plank engaging those of each adjacent plank. The flexible membrane spans the length of each plank and hence the width of the finished roadway. Each section of membrane has a length equal to approximately twice the length of the bed of the transporter vehicle. Each section of the roadway thus comprises two vehicle bed-lengths of planks held together by the separate flexible membranes. Adjoining sections are hinged together on the side of the adjoining planks which is opposite from the side on which the membrane is attached. This novel arrangement facilitates the stacking of the roadway layer upon layer on the transporter vehicle bed and permits the roadway to be easily and quickly payed out or deployed when it is needed, either from the rear of the deploying vehicle or over the front thereof.

DETAILED DESCRIPTION OF A PREFERRED EMBODIMENT

Figure 1:
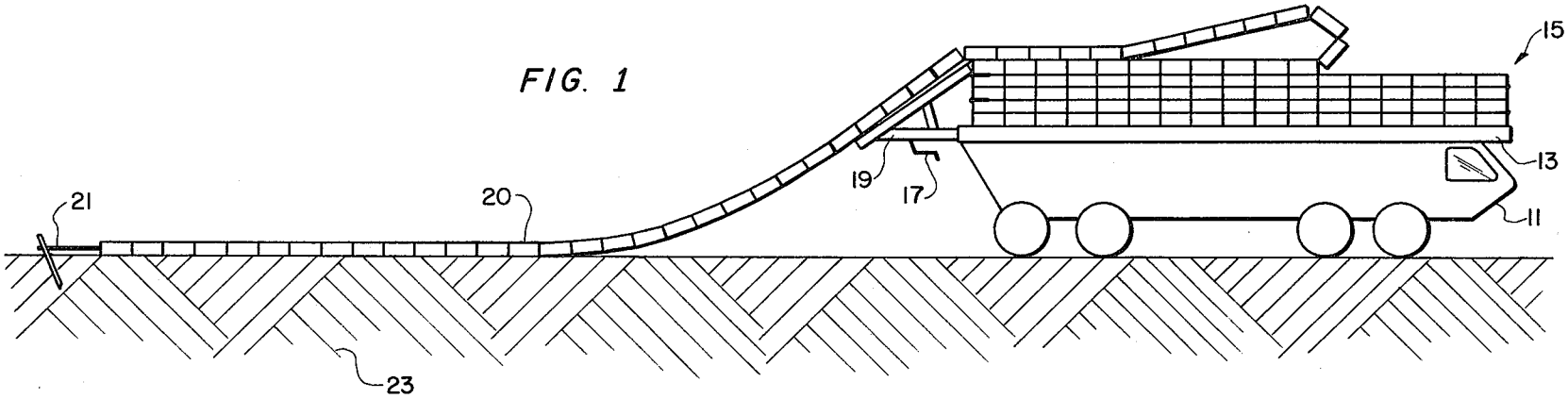
FIG. 1 shows the roadway being deployed from the rear of a transporter vehicle.

In FIG. 1 there is shown a transporter/launcher vehicle 11. Vehicle 11 is shown as self-propelled, with a flat bed 13 extending the full length of the top thereof. Vehicle 11 is shown in the process of deploying transportable roadway 20 from the rear thereof to the ground 23. Roadway 20 comprises an articulated array of sections of planks held together with flexible tension membranes and hinges, which will be described in detail in connection with FIGS. 3, 4 and 5. The roadway 20 is anchored to the ground by anchor 21 and as vehicle 11 is driven forward or to the right in FIG. 1, the roadway will be pulled off of the vehicle layer by layer, as shown, over an adjustable rack 19 at the rear of the bed 13. The adjustable rack 19 is adjusted progressively to permit only the uppermost successive layers of roadway to be pulled off. As each layer is deployed, the rack 19 must be lowered, for example manually by means of crank 17. Suitable trip lever and related mechanism (not shown) may also be embodied to effect automated or semi-automated operation.

The planks used in the roadway 20 are as long as the width of the finished roadway, which would be made wide enough to accommodate the largest vehicle to be driven thereon. As the roadway is pulled over the rack 19 at the rear of bed 13, the topmost layer, having a flexible membrane at the bottom thereof, slides over the next layer, simultaneously peeling the next layer off, as illustrated. The next layer has its flexible membrane on the top of each of the planks, so that as the next layer is peeled back and each plank thereof turned through 180 degrees, the planks of the next layer will all be above the flexible membrane to which they are bonded, as the planks pass over rack 19 to the ground.

Figure 2:
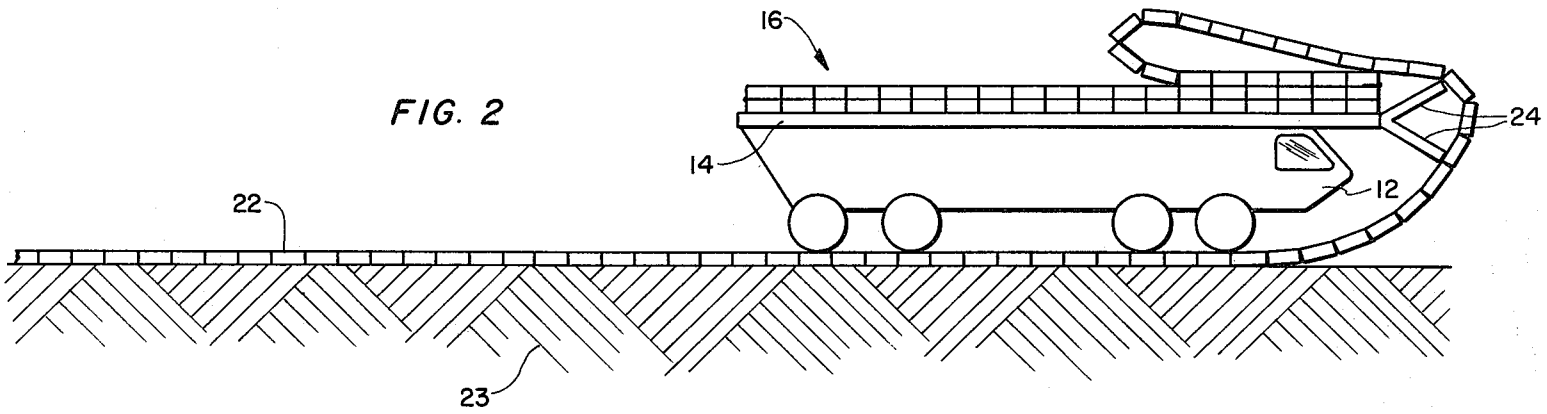
FIG. 2 shows how the roadway may also be deployed over the front of a transporter vehicle.

FIG. 2 shows how a similar transporter/launcher vehicle 12 can be arranged to deploy a similar roadway 22 over the cab thereof to the ground 23. No anchor is needed in this embodiment, since the vehicle rides over the deployed roadway. The guides 24 attached to the front end of the bed 14 of vehicle 12 guide the roadway 22 as it passes in front of the cab. In the embodiment of FIG. 2, the flexible tension membranes which hold most of the planks together will be on the top of the planks as they rest on the ground 23. This is a slight disadvantage compared to the roadway of FIG. 1, since not as much buoyancy can be obtained from adjoining planks with this arrangement, however the arrangement of FIG. 2 has the advantage that the deploying vehicle need not travel directly over the swampy or marshy terrain over which the roadway is being deployed. Thus in the embodiment of FIG. 2, the roadway could be deployed in an area which otherwise would be impassible to the deploying vehicle without the aid of the deployed roadway.

Figure 3:
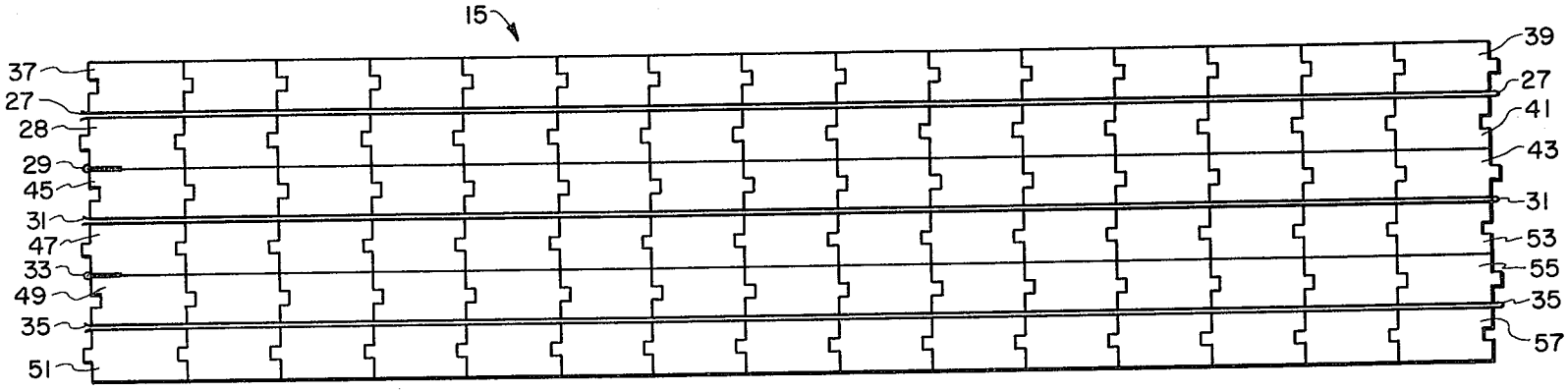
FIG. 3 shows how the roadway is arranged on the transporter vehicle bed, either for rear-deployment as in FIG. 1 or front-deployment as in FIG. 2.
Figure 4:
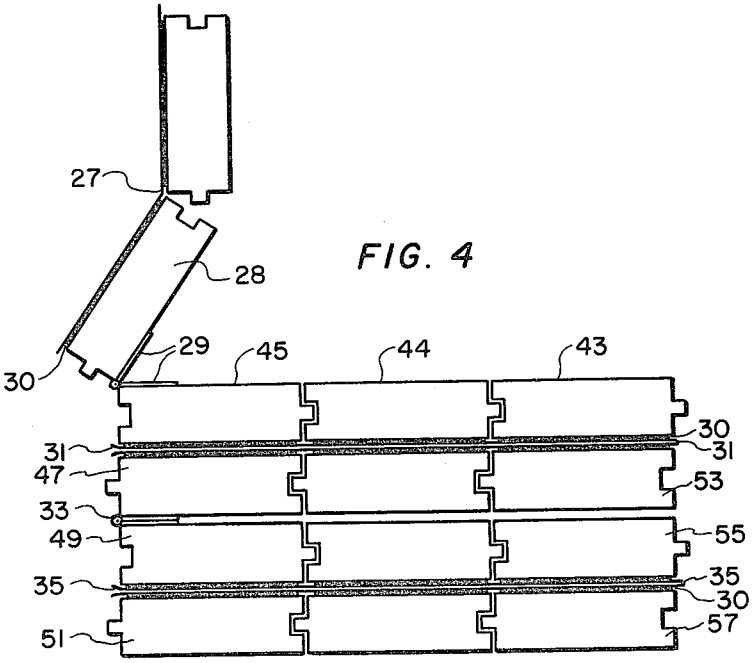
FIG. 4 shows an enlarged view of a portion of the roadway of FIGS. 1 and 2 as it is being deployed.

FIG. 3 shows three sections comprising six layers of the roadway as it would be arranged loaded onto a transport/launcher vehicle ready for transport and/or deployment. If this roadway 15 were loaded onto a rear-deploying vehicle such as that of FIG. 1, the front of the vehicle would be on the right in FIG. 3 and the plank 37 would be the first plank to be deployed over the rear of the vehicle. If the roadway 15 were loaded onto a front-deploying vehicle such as that of FIG. 2, the front of the vehicle would be at the left in FIG. 3, with the plank 37 being the first to be deployed over the vehicle cab. Each layer of the roadway of FIG. 3 comprises fifteen planks viewed in end elevation in FIG. 3. The two topmost layers of planks are bonded to a first section of flexible tension membrane 27, the membrane being folded at its right-hand end, with the top layer of planks bonded to the upper fold of the membrane 27 and the second layer of planks being bonded to the lower fold of the membrane 27. Thus the top layer of planks has the upper fold of the membrane 27 bonded to the bottom broad surface of each plank thereof, and the second layer has the lower fold of the same membrane bonded to the top broad surface of each plank thereof, as seen in FIGS. 3 and 4. All of the planks of the first layer have their tongues facing to the right, and those of the second layer have their tongues facing left. The leftmost plank 28 of the second layer is connected to the plank 45 which is the leftmost plank of the third layer by means of a hinge 29, more clearly illustrated in FIG. 4. The remainder of the layers repeat the structure of the two topmost layers to form successive sections. The third and fourth layers from the top are both bonded to a folded flexible tension membrane 31, and a hinge 33 connects the plank 47 to plank 49 to connect the third and fourth layers to the two bottom layers. The two bottom layers are bonded to folded flexible membrane 35 to make the lowermost section. Thus it can be seen that the six layer roadway of FIG. 3 comprises three sections, each section being bonded or attached to separate folded membranes, with the junctions of each section being connected with hinges. The hinges 29 and 33 may be fabricated of a fabric or material like that of the tension membrane and extend substantially across the entire length of the planks to which they are attached, or there may be a plurality of hinges arranged side by side connecting each pair of planks.

In deploying the roadway of FIG. 3 from the rear of a transporter vehicle such as that of FIG. 1, the top layer would be pulled to the left over the rack 19, with the plank 37 attached to the anchor 21 to form the start of the deployed roadway. As the top layer of the roadway slides over the next or second layer it peels back the planks thereof one by one, as shown in FIG. 1, and reverses the orientation of the second layer of planks, so that the tension membrane of the second layer is below the planks as they pass over the rack 19 onto the ground. Since the tongues of all the planks on the top layer face the right and those of the second layer face left, when the second layer is reversed in orientation, all of the tongues of the deployed roadway will face the right, as viewed in FIG. 1. As the leftmost plank 28 of the second layer is reached in the deployment operation, the hinge 29 connecting this plank to plank 45, which is the first plank of the next section, will permit the plank 28 to pivot or swing around so that planks 28 and 45 are aligned and the third layer comprising planks 45 and 43 will begin to slide to the left over rack 19, simultaneously peeling back the planks of the next lower layer which are attached to the same tension membrane 31.

FIG. 4 shows in larger scale how the plank 28 rotates counterclockwise around hinge 29, so that the tongue on plank 28 engages the groove in plank 45. In FIG. 4 only three planks are shown in each layer to permit a larger scale to better illustrate the motion of the planks during deployment. In FIG. 4 the bonding material which holds the planks to the fabric is indicated by reference numeral 30.

The flexible tension membranes are preferably composed of some artificial fabric such as nylon or Kevlar. These materials combine high strength with low coefficient of friction. Since each upper layer of each section of roadway must slide over the lower layer thereof and each said upper layer has the tension membrane on the bottom thereof while each said lower layer has the flexible membrane on the top thereof, the deployment operation will result in each tension membrane sliding over itself. Thus, the use of low friction material for this membrane will permit deployment with minimum effort.

The matter in which the roadway of FIGS. 3 and 4 is deployed over the front of a vehicle as shown in FIG. 2 is much the same as has been described for the rear-launching version in FIG. 1. The sliding of one layer over another and the peeling back of planks of the lower layer of each section would be the same in either case. The major difference being that, as previously stated, the deployed roadway of FIG. 2 will have the membranes on the top with the planks beneath them. In initiating the deployment operation the plank 37 would be pulled over the cab and the guides 24 of the launcher vehicle, which would be facing left in FIGS. 3 and 4, and the vehicle driven to the left over the roadway, which would be placed in front of its wheels. Thus the vehicle's engine would provide the power to pull the roadway off of its bed.

Figure 5:
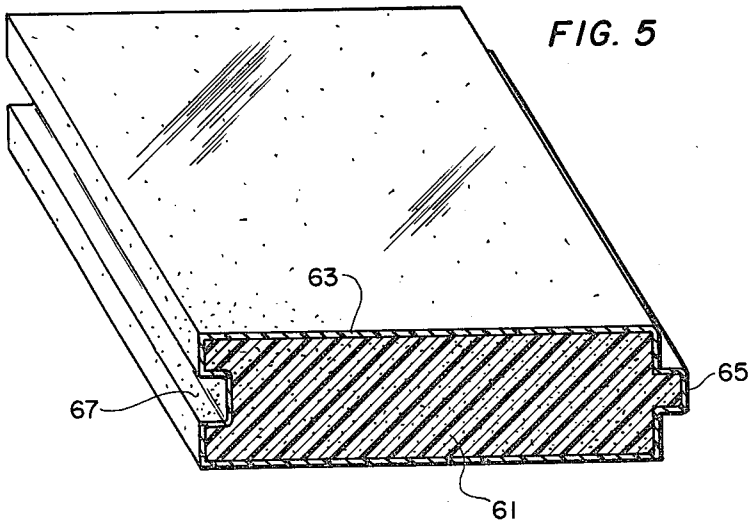
FIG. 5 is a cross-sectional view in perspective of a plank, showing the interior details thereof.

The sectional view of a plank of FIG. 5 shows the groove 67 on one side thereof and the tongue 65 on the other. The plank is composed of a core 61 of lightweight plastic material, such as expanded plastic, for example, polyurethane. A tough, hard skin 63 such as fiberglass is applied to the core 61 to seal out air and moisture and provide strength. The result is a strong plank of high buoyancy. The skin may be applied by hand or by spraying, and a heated split form or mold may be used to cure the skin and set the tolerances of each plank. The planks may be bonded to the fabric or tension membrane in any suitable manner, as by use of a cold cure adhesive.

In a typical roadway, the planks may be 4 to 6 inches thick, 18 to 30 inches wide and 13 feet long. A typical vehicle bed may be 50 feet long. If ten sections, each comprising two layers are loaded onto such a vehicle, the deployed roadway will be 1000 feet long and 13 feet wide.

It is contemplated that the roadway may be retrievable under certain circumstances, and if this is desired, the reverse of the procedures described hereinabove would essentially achieve the desired retrieval.

It is understood that a best mode of the invention has been described, but that numerous changes may be made in the various details of construction, arrangement and operation without departing from the spirit and scope of the invention as defined in the appended claims.

I claim:

1. A transportable roadway comprising an articulated array of planks arranged edge to edge with the length of each plank comprising the width of the deployed roadway, each plank having a tongue on one edge thereof and a mating groove on the other edge thereof, said roadway comprising a plurality of sections, each section comprising a plurality of said edge to edge planks, each of said planks being attached or bonded on one broad side thereof to a flexible fabric or membrane with the tongues and grooves of each plank engaging the tongues and grooves of adjacent planks, adjacent sections of said roadway being connected to each other by means of hinges connecting the planks at each end of said sections to the corresponding planks at the end of each adjoining section, said hinges being on the side of said planks opposite from said flexible fabric, whereby said roadway may be folded layer upon layer on the bed of a transporter/launcher vehicle having a bed length equal to approximately one half of the length of each section of said roadway and whereby said roadway may be quickly and easily deployed either from the rear of said vehicle or from the front thereof over the cab of said vehicle.

2. The roadway of claim 1 wherein each of said planks comprises a core of lightweight expanded plastic with a strong, hard skin of fiberglass, whereby said planks combine high buoyancy and high strength.

3. A system for transporting and deploying a temporary, foldable, man-made roadway, comprising: a transporter/launcher vehicle having a flat bed adapted to receive said roadway folded layer upon layer thereon; said folded roadway comprising an even number of layers; each two adjacent layers, designated as the upper layer and the lower layer, comprising a section; each section comprising a once folded flexible fabric or membrane having bonded thereto an edge to edge array of planks, said planks having top and bottom broad surfaces, and extending across the width of said vehicle bed; said once-folded fabric having an upper fold and a lower fold, the upper fold being bonded to the bottom broad surfaces of the planks of said upper layer and the lower fold being bonded to the top broad surfaces of the planks of said lower layer; each of said sections being connected to the adjacent section by hinge means, whereby said roadway may be quickly and easily deployed either over the rear or the front of said transporter/launcher.

4. The system of claim 3 wherein each of said planks comprises a core of lightweight expanded plastic and having an encapsulating strong, hard skin of fiberglass or the like, whereby said planks combine high buoyancy and high strength, and wherein said flexible fabric comprises nylon or Kevlar.

5. The system of claim 3 wherein each of said planks has a tongue on the longitudinal edge thereof and a groove at the opposite longitudinal edge, and whereby said tongues and grooves of adjacent planks engage each other, thereby distributing the vehicular load on said roadway over a number of adjacent planks.

6. The system of claim 3 wherein said hinges means include hinge members located on the broad surfaces of said affected planks opposite from the broad surfaces on which said flexible fabrics are located.

7. The system of claim 3 wherein said transporter/-launcher has an adjustable rack at the rear of said flat bed, said rack being adjustable up and down to progressively permit only the successive uppermost layers of said folded roadway to be deployed from the rear of said transporter/launcher, the uppermost section having a free end which is adapted to be pulled over said rack and anchored to the ground to the rear of said transporter/launcher, whereby said roadway will be pulled off of said vehicle bed layer by layer as said transporter/launcher is driven forward.

8. The system of claim 3 whereon said transporter/-launcher has a pair of guides projecting from the forward end of said flat bed, whereby said roadway is adapted to be deployed layer by layer over the front of said transporter/launcher and under the wheels thereof.

9. A transportable roadway comprising: an articulated array of lightweight, strong planks arranged edge to edge with the length of each plank comprising the width of the deployed roadway; said roadway comprising a plurality of sections; each section comprising a plurality of said edge to edge planks each having a broad side bonded to a folded flexible sheet of nylon fabric; the adjacent sections of roadway being connected to each other by means of hinges connected at each end of said sections to the planks at the end of each adjoining section of said roadway, said hinges being on the opposite sides of said planks from said flexible nylon fabric, whereby said roadway may be folded layer upon layer on the bed of a transporter/launcher vehicle having a bed length equal to approximately one half of the length of each section of said roadway, and whereby said roadway may be quickly and easily deployed either from the rear of said vehicle or from the front thereof over the cab of said vehicle.

10. The roadway of claim 9 wherein each of said planks comprises a core of lightweight expanded plastic with a strong, hard plastic skin thereon, such as fiberglass or the like, and whereon each of said planks has a tongue at one edge thereof and a groove at the opposite edge, and wherein the tongue of each plank engages the groove of each adjacent plank.

11. A temporary, man-made roadway comprising: an articulated array of strong, lightweight plastic planks arranged edge to edge with the length of each plank comprising the width of the deployed roadway; said roadway further comprising a plurality of sections; each such section comprising an equal length of a flexible artificial fabric such as nylon, and having a plurality of said planks bonded to one side of said artificial fabric; each of said planks having a tongue at one edge thereof and a groove at the opposite edge thereof, with the tongues and grooves of adjacent planks mating with each other; and adjacent sections of said roadway being connected by hinges attached to the end planks of each section on the side of said planks opposite from that of said fabric.

* * * * *